US005107572A

United States Patent [19]

Schmid et al.

[11] Patent Number: 5,107,572

[45] Date of Patent: Apr. 28, 1992

[54] DEVICE FOR THE DISPOSAL OF WASTE IN A FIBER CLEANING MACHINE

[75] Inventors: René Schmid, Niederneunforn; Ulf Schneider; Peter Anderegg, both of Winterthur; Martin Kyburz, Andelfingen, all of Switzerland

[73] Assignee: Maschinenfabrik Rieter AG, Winterthur, Switzerland

[21] Appl. No.: 669,687

[22] Filed: Mar. 14, 1991

Related U.S. Application Data

[62] Division of Ser. No. 551,327, Jul. 12, 1990, Pat. No. 5,033,166.

[30] Foreign Application Priority Data

Jul. 12, 1989 [CH] Switzerland ..... 26130/89

[51] Int. Cl.[5] ..... D01G 5/00; D01G 13/00; D01G 15/82

[52] U.S. Cl. ..... 19/200; 19/107; 241/34

[58] Field of Search ..... 19/107, 203; 222/108, 222/185, 368, 460, 462; 241/34; 250/226

[56] References Cited

U.S. PATENT DOCUMENTS

| | | | |
|---|---|---|---|
| 2,304,753 | 12/1942 | Seidenstricker | 222/108 |
| 3,172,165 | 3/1965 | Helm | 19/203 |
| 3,388,434 | 6/1968 | Calhoun, Jr. | 19/303 |
| 3,895,745 | 7/1975 | Hook | 222/368 |
| 4,091,507 | 5/1978 | Sutter | 19/107 |
| 4,092,764 | 6/1978 | Thomas et al. | 19/107 |
| 4,179,043 | 12/1979 | Fischer | 222/368 |
| 4,344,579 | 8/1982 | Morita et al. | 241/34 |
| 4,461,428 | 7/1984 | Williams | 251/34 |
| 4,528,901 | 7/1985 | Vick et al. | 241/34 X |
| 4,572,441 | 2/1986 | Sangati | 241/34 |
| 4,948,017 | 8/1990 | Heep et al. | 222/368 |
| 4,953,752 | 9/1990 | Tousignant et al. | 222/185 X |
| 4,986,665 | 1/1991 | Yamamishi et al. | 250/226 X |

*Primary Examiner*—Werner H. Schroeder
*Assistant Examiner*—John J. Calvert
*Attorney, Agent, or Firm*—Burns, Doane, Swecker & Mathis

[57] ABSTRACT

A discharge device for discharging the waste from a fiber cleaning machine having a collecting basin and a blowing or sucking device. The discharge device has a collecting basin which is funnel shaped with a motor driven paddle wheel in the tapered part. The waste removal is controlled on the basis of weight indicating and/or filling level indicating sensors which are assigned to the collecting basin.

30 Claims, 3 Drawing Sheets

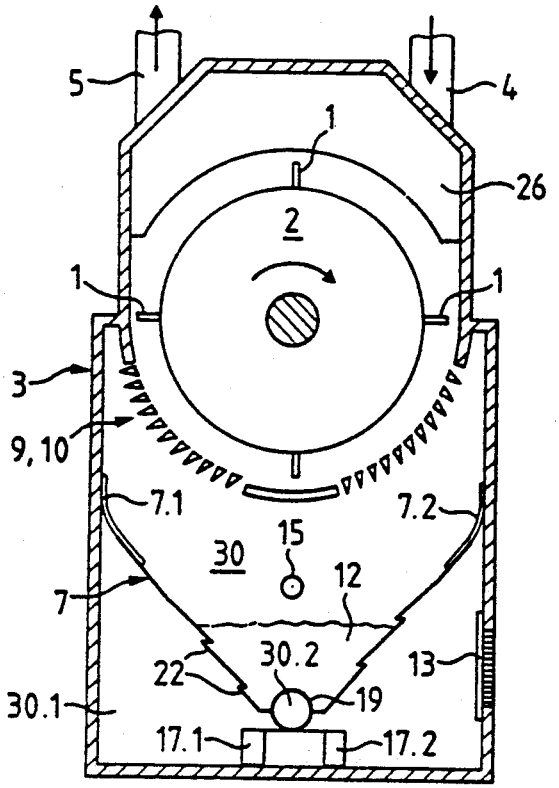
FIG 5A
FIG. 5B
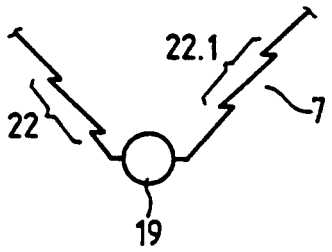
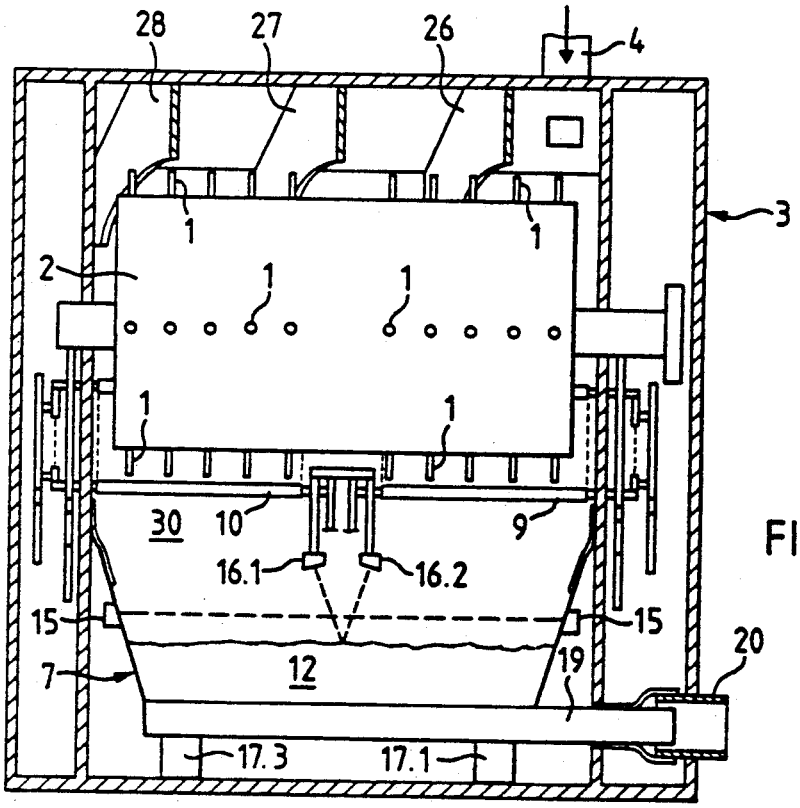
FIG. 6

DEVICE FOR THE DISPOSAL OF WASTE IN A FIBER CLEANING MACHINE

This application is a divisional of application Ser. No. 551,327, filed Jul. 12, 1990, now U.S. Pat. No. 5,033,166.

FIELD OF THE INVENTION

The invention relates to the field of textile technology and in particular relates to a method for the disposal of waste in a fiber cleaning machine and a device for accomplishing this objective.

BACKGROUND OF THE INVENTION

The cotton fibers pressed into bales must, until they are capable of being spun, not only be brought from their irregular compressed position but also freed from all types of impurities. In the bale opening machine, the compressed cotton must be opened into flakes and transferred by means of a current of delivery air into a cleaning machine. Depending on the degree of contamination, this is a fine or coarse cleaning machine, whereby both are used as a rule. The present invention provides a device which is preferably used in coarse machines. However, it can also be used in an appropriate form in fine cleaning machines.

In cleaning machines of this type, the flakes are preponderantly opened to increasingly small collections of fibers, which are still flakes, whereby loose foreign particles separate from the composition and fall out. The opening takes place exclusively in a type of plucking and beating operation which is effected by means of rapidly revolving toothed rollers and beater rods. This rapid rotary flow, together with the inflow and outflow currents cause dynamically produced air currents, which are indeed drawn into the cleaning process but are not decisive in their total effect. This is one reason, which according to each phase of the operation, a comparatively large number of good fibers are excluded from the process and, if necessary, must go through a recycling process.

SUMMARY OF THE INVENTION

The invention relates not only to a method for the disposal of the waste produced so that the cleaning program is not substantially affected by the periodical discharge of this waste, but also to a device which lessens the good fibers in the output operation in that the discharge operation of the separated particles of dirt is so controlled that the only regulated quantities of good fibers are still removed with the waste.

In the known coarse or fine cleaning machines, a flock stream is produced pneumatically. In this flock stream, the mechanical cleaning process is so established that particles which are heavier than the fiber flocks leave this pneumatically operated flock stream by means of their own weight and fall due to gravity into a collecting pan which is removed from time to time. It is exactly this emptying operation which breaks down the aerodynamic equilibrium of the flock stream of the integrated cleaning process in such a way that, in addition to the particles of dirt, a quantity of fibers is also removed. In a continuous process, these intermittent losses accumulate to a loss of considerable size, which cannot be further tolerated. Consequently, a decoupling of both operations, namely the cleaning operation and the disposal operation is desirable.

BRIEF DESCRIPTION OF THE DRAWINGS

The invention is discussed with reference to the following drawings, in which:

FIGS. 5A and 5B show a further embodiment of the device according to the invention, FIG. 5B showing a detail of a modification of the trough; and FIG. 6 shows the device according to FIG. 5A in a longitudinal section.

DETAILED DESCRIPTION OF THE PREFERRED EMBODIMENTS

Figure 1:
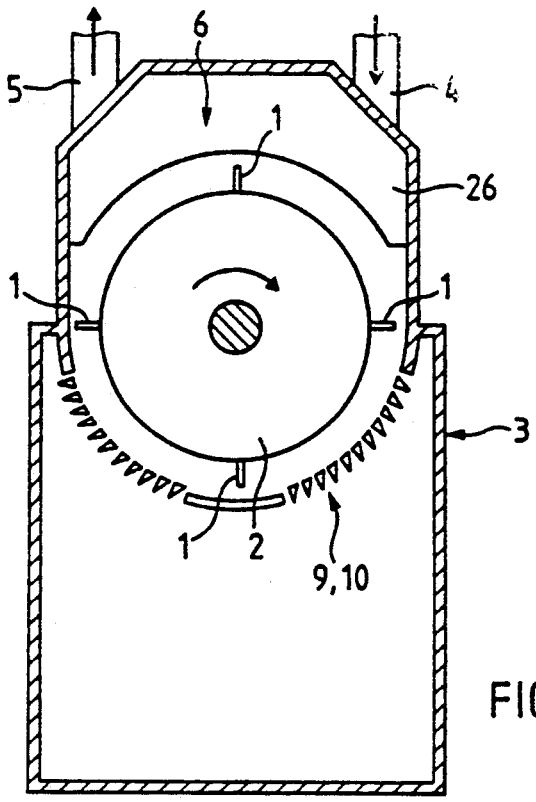
FIG. 1 shows a schematic vertical section through a cleaning machine for textile fibers without the device according to the invention.

The cleaning machine shown in FIG. 1 has an opening roller 2 equipped with beater rods 1, the roller 2 rotating in a casing 3 about a horizontal axis. Over the upper side of the opening roller 2, the casing 3 has an inlet 4 and an outlet 5, which are connected over a chamber 6, for a current of delivery air for transporting the textile fiber in flock form. The inlet 4 is arranged at one end of the roller 2, whilst the outlet 5 is arranged at the other end of the roller 2. Between the inlet 4 and the outlet 5, three deflector sheets 26, 27 and 28 inclined to the axis of the roller 2 are arranged above the upper side of the opening roller 2. The deflector sheets define two transfer chambers therebetween located above the upper side of the roller 2 and below the upper wall of the casing 3.

On the underside of the opening roller 2, there are beater rods with bar grates parallel to the roller. Preferably, as shown in FIG. 1, two groups of bar grates 9 and 10 are arranged one behind the other in the peripheral direction of the opening roller 2. In operation, the textile fibers to be cleaned and opened are conveyed to the cleaning machine in a current of delivery air through the inlet 4. The delivery air with the fiber flocks first flows substantially around the underside of the rotating opening roller 2, then through the transfer chamber between the deflector plates 26 and 27, which further move the air in the direction of the axis of the opening roller 2, then again around the underside of the roller in order to leave the machine finally through the outlet 5. When running around the underside of the roller 2, the fiber flocks are worked on by the beater rods 1 and stroked, beaten and conducted past the bar grates. As a result, impurities from the fibers are separated and removed from the fiber flocks through the bar grates and into a chamber 30 under the bar grates, in which only a slight excess pressure prevails by a stream of delivery air which does not affect the direction of suction and is sucked out by the object of the invention. It can be seen immediately that this current equilibrium (please note static) through the overpressure or pressure head formed in the enclosed chamber 30 underneath the bar grates, is then considerably disturbed when this chamber pressure alters rapidly. This occurs, for example, when the impurities are sucked out, as air is taken from the chamber in a series of gulps.

Figure 2:
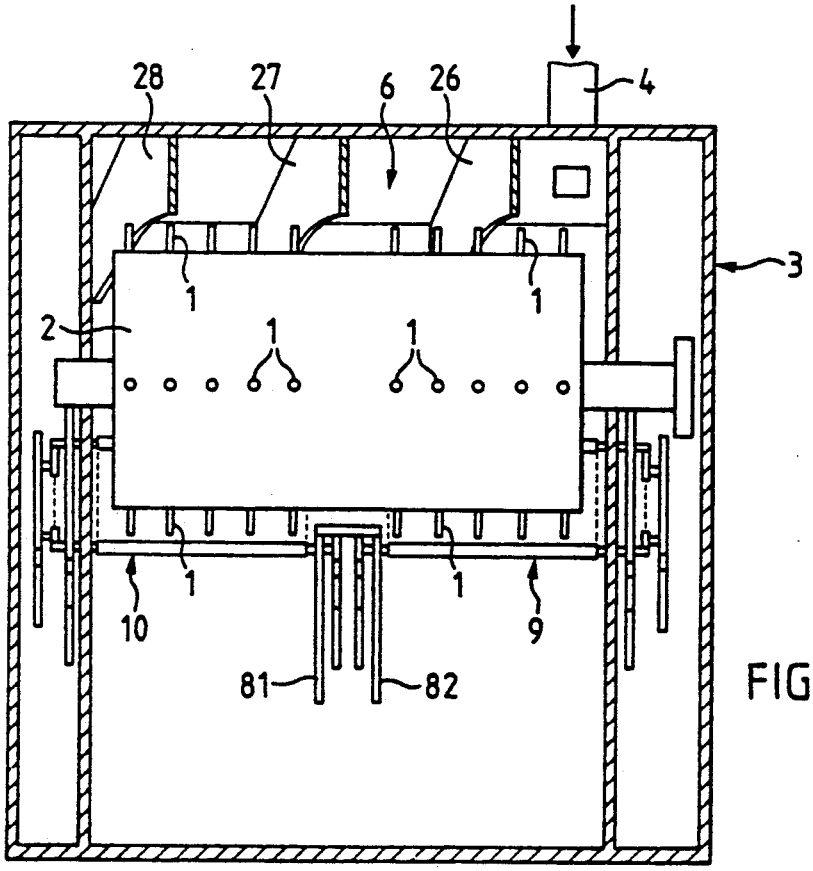
FIG. 2 shows the cleaning machine from FIG. 1 in a longitudinal section.

FIG. 2 shows the cleaning machine from FIG. 1 in a longitudinal section, in order to show that the flock stream does not only circulate but rather runs in a spiral path, which is also disturbed by the pressure head at some point or other. At the inlet 4, the flock stream runs in on one side of the cleaning roller 2 and is from there forced into a spiral flow by the deflector plates 26, 27, 28, inclined to the direction of flow, in order to emerge again at the other end of the cleaning roller. As the bar grates are adjustable on the machine represented here and are divided in two parts along the length of the roller, which is the subject of Swiss Patent Application 00321/89, holders 81 and 82 are provided for controlling the bar grates or specially provided holders can be provided on which sensors 16 (described later) can be fastened, for instance. It can also be seen that the chamber beneath the roller has a rectangular cross section and has approximately the shape of a pan.

Figure 3:
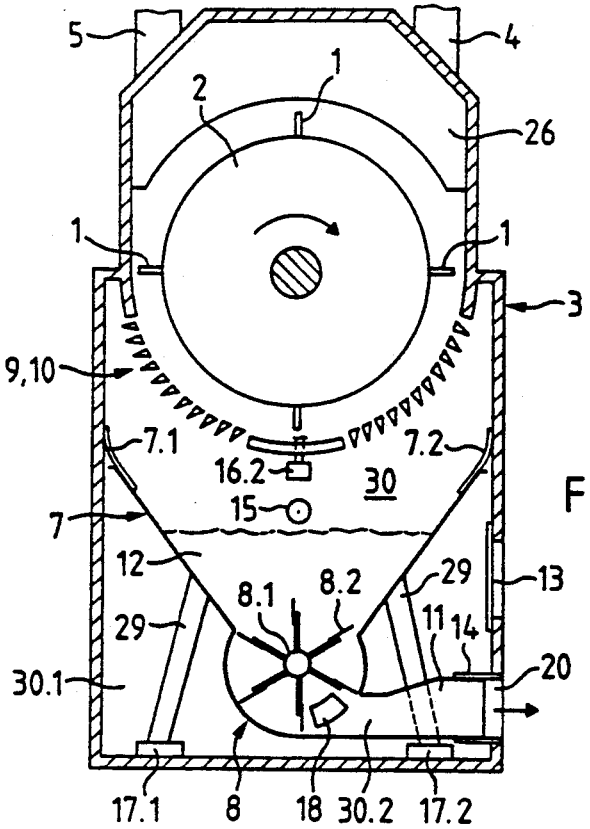
FIG. 3 shows a schematic representation of the device according to the invention in the cleaning machine arranged according to FIGS. 1 and 2.

FIG. 3 shows a cross-sectional view of the entire cleaning machine with an inventive device which will now be discussed. Only the major parts are shown, of which the functional connection is also shown. The upper part corresponds to the machine as described in connection with FIG. 1. In the lower part, instead of providing a catcher pan and suction device according to the present state of technology, an entirely new device is arranged according to the invention. With this device, the particles of dirt which are trapped are removed from the machine, without disturbing the current equilibrium in such a way that good fibers emerge. The reciprocal effect between the removal function and the cleaning function is largely decoupled or minimized.

In the lower part of the cleaning machine, that is, in the chamber 30 in which the collecting pan is situated, an excess pressure is formed immediately when the machine goes into operation. With the removal of the waste, the pressure difference must also be overcome without the formation of current conditions in the upper part of the cleaning machine. If the machine is opened, for example, in order to remove the waste, such an operation produces a sudden pressure drop, which is propagated in the cleaning current and disturbs its outflow. This disturbance effects a diversion of the main current from the bar grates, so that flocks would fall into the collecting pan, which actually should have been conveyed to the outlet 5. Efforts must therefore be made to carry out a type of discharge so that stable pressure conditions (from outside and inside) are always maintained in operation. In order to achieve this objective, according to the present invention a part of the waste material is used as a current buffer filter.

The aerodynamic (pneumatic) disturbance of the cleaning current does not take place through the quantity of infiltrated air, which flows from the side with the high pressure to the side with low pressure, but rather through their dynamics that, their acceleration and rate of flow. Consequently, it must be attempted to make the dynamics of this disturbance reliably smaller as opposed to the dynamics of the cleaning process. If then the infiltrated air dynamics are kept correspondingly small, figuratively represented, the disturbance is considerably smaller if it is allowed to run as a soft curved bell shaped impulse instead of a square wave impulse. The relatively light, slightly flocculent waste is then rapidly and easily formed into a pressure damping mat which is air permeable to the infiltrated air current, so that the infiltrated air current is chronologically delayed. This brings about the desired damping.

According to a method of the invention, this is achieved in that the waste is caught in a collecting pan until it has reached a certain layer thickness. The discharge of the waste is then partially carried out in that, each time waste is removed, a protective layer remains between the upper chamber of the cleaning machine in which the cleaning takes place and the removal sluice, which leads outwards from the machine. Accordingly, a discharge only takes place when a first predetermined level of filling has been reached and only so much is removed that a second predetermined level of filling still remains. With these two requirements, a protective layer is formed and retained for the retention of the pressure difference, as it were. This is shown in FIG. 3.

The above method of the invention can be carried out with an arrangement which includes a collecting trough 7 fitted with a paddle wheel 8 in the form of rotating segments on a driven axis 8.1, the laminations or blades 8.2 being paddle shaped. For each partial revolution of the paddle wheel, a predetermined part of the total waste is separated or removed from the collecting trough 7, which is apparent from lowering of the filling level. A filter or pressure clamping layer 12 of waste still remaining in the collecting trough 7 is sufficient to dampen a possible drop in pressure and the filter layer is built up again by the waste trickling downwards in a continuous cleaning process. This discharge/build up operation is controlled by means of weight and/or filling level sensors 15, 16.1, 16.2, 17.1, 17.2, which are represented schematically in FIG. 3. Moreover, additional means 13, 14 are provided in order to guard against an undesirable pressure balance or pressure inversion. These means are as a rule, packings, which work as valves.

As weight sensors 17.1 and 17.2, pressure measuring cells are used as a rule, on which the trough 7 is carried on supports 29 with the paddle wheel 8 and a drive 21, 21.1 and 21.2. With the aid of measurement signals from the pressure cells, the removal from the sluice layer and the rebuilding of the filter layer can be determined through a weight difference calculation. However, the build up of the filter layer can also be controlled by sensors independently of the weight of the waste, whereby the control is independent of the waste weight itself, which can alter continually. In this case, the material discharge is supervised by the signal from the pressure measuring cell, as an additional calculation the waste weight and the absolute quantity of the quantity of the waste can be determined. A supersonic distance measuring device can also serve as a filling level sensor. Additionally, the color of the waste can be supervised with light sensors, in order that remedial measures (stopping the machine) can be undertaken in the case of an alteration of the set and controllable fiber/contamination relationship. Such settings are carried out by suitable means such as data processing means, mechanically actuated systems, etc., for instance, which are incorporated in the total process for control purposes.

FIG. 3 shows the dynamic or pneumatic relationship in the overall equipment very clearly in a schematic representation. The flock stream runs above the bar grates 9 and 10, the flocks from which are conveyed over the bar grates so that this stream cannot be regarded as a homogeneous current. However, the bar grates and the pressure head build a subtle equilibrium in a fringe area, which is not only important for the separation of the fibers from the dirt particles but also for the purpose that, after the separation, the fibers are not moved out of the current. The fringe layer must not be "disturbed" and the removal of the waste must be dynamically decoupled. The laminations 8.2 of the paddle wheel 8 are shown in two parts in FIG. 3, the outer part can be rubber, flexible plastic or similar material, with which the gap between the laminations and the wall of the trough can be sealed. A certain quantity of infiltrated air will always escape from the pressure head chamber 30 during the discharge operation and cause pressure fluctuations, the dynamics of which must be damped. The permanently continuing renewal of the filter layer from waste material serves this purpose.

The trough is closed above, on a transition between the pressure head chamber 30 (defining a first pressure zone) and a discharge chamber 30.1. For this purpose, suitable sealing means such as flexible flaps 7.1, 7.2 are fitted, which are pressed against the walls of the trough through the pressure head. Pressure variations are unavoidable in the lower discharge chamber 30.1, as in a suction chamber 30.2 (defining a second pressure zone) a spontaneous underpressure is produced by the suction, which sucks air out of the discharge chamber 30.1 (defining a third pressure zone) through an opening 18, which then causes air to pass into the discharge chamber 30.1 through suitable means 13 such as an opening. This air then is sucked out for the discharge and reaches the suction chamber 30.2 through the opening 20 into which the waste is conveyed, so that the waste conveyed by the paddle wheel 8 is sucked out. A sluice of this type is known as a "blower sluice" in technical terminology. The pressure in the chamber 30.1 is greater than in a suction pipe 11 so that the infiltrated air always flows through the trough 7 from the pressure head chamber 30 through the waste filter 12 with the stable excess pressure through the waste filter and not in the direction towards the pressure head chamber 30.

The pressure relationships are as follows: chamber 30 (first pressure zone) excess pressure; chamber 30.1 (third pressure zone) normal to excess pressure; chamber 30.2 (second pressure zone) underpressure. The pressure drop runs from 30 to 30.1 to 30.2, whereby the pressure head in the chamber 30 is bordered by two different pressure drops. As the trough 7 with the paddle wheel 8 is also subjected to a weighing operation, it must be possible to decouple it during the weighing operation, in other words, the use of fixed seals is not recommended. In this embodiment, press on seals are preferred, which are shown as flaps in FIGS. 3 and 4 which only make contact when there is underpressure in the chamber 30.2. All the seals then have the function of a valve and on the other hand, they can be decoupled for a weighing operation, as the weighing operation occurs before the discharge of the waste.

The filling level sensors are a light barrier or photosensor 15 in this embodiment (it can also be a supersonic distance measuring sensor with transmitter and receiver included, for instance, in the positions 16.1 and 16.2). The light barrier 15 can also be inserted as a limiting value sensor, whilst the supersonic sensor is detailed for the measurement of the actual filling level, with the signals of which the damping filter layer is regulated. If only a light barrier is used, the following steps can be carried out: (1) with the light barrier open the waste is permitted to build up without discharge; (2) with the light barrier interrupted the waste is discharged. With a measurement of the clearance, it is possible to move the paddle wheel 8 slowly as a function of the waste quantity, so that the filling level does not alter so suddenly and at the right moment initiates the pneumatic removal which, as a rule, takes place in a spontaneous sucking out. In this way, it is possible to stretch out the pressure head variations chronologically and keep them to a minimum amplitude.

In addition to the sensors arranged in the locations 16.1 and 16.2, color sensors can also be arranged, which measure the color of the waste. The sensors themselves are not shown here, only the location where they are fitted is shown such as at locations 16.1 and 16.2, since the number, location and type of the color sensors will depend on the function required. To optimize the cleaning process, it may be desirable for good fibers to reach the waste, from where they can be separated in a second cleaning operation. For example, this is the case when cleaning must be very intensive and the intensity is too great for the contamination to be removed in a single operation. This requires machine settings of such a type that a predetermined degree of brightness of the waste can be established by means of optical sensors.

When discharging, the weight measurement must be stopped, as the trough is "shaken" at this moment. The sealing of the trough against the pressure head can, as stated earlier, be effected with rubber flaps, which are pressed against the trough wall through the pressure head, so that no fixed connection exists between the weighed element and the machine. There always is a lower pressure underneath the trough, which becomes even lower during the discharge operation (suction). Therewith, there is always a sufficient pressure difference for pressing the seal down.

When starting and stopping the machine, the pressure relationships are always unstable at the start (time function). Through this, higher waste must be reckoned with, as the trough is empty at the start. This higher starting waste has the advantage, however, that the leaks which produce the infiltrated air are covered more rapidly and therewith the state of equilibrium is also attained more rapidly.

The means 13 can comprise a valve device which acts as a non-return valve or one-way valve. For instance, the means 13 can comprise a sieve plate covered with foil. Likewise, at the outlet of the trough, rubber sleeves 14 or similar means are fitted, which are closed or pressed on when discharging through the normal pressure/suction underpressure difference and are automatically decoupled when weighing. The decoupling can then be neglected when the connection between the trough and the casing 3 does not disturb the weight measurement because of adequate flexibility. For the weight measurement, the trough must stand either completely free or be substantially uninfluenced because of the flexibility of the connections and, as far as possible, should not be subjected to any accelerations, shaking or vibrations.

Figure 4:
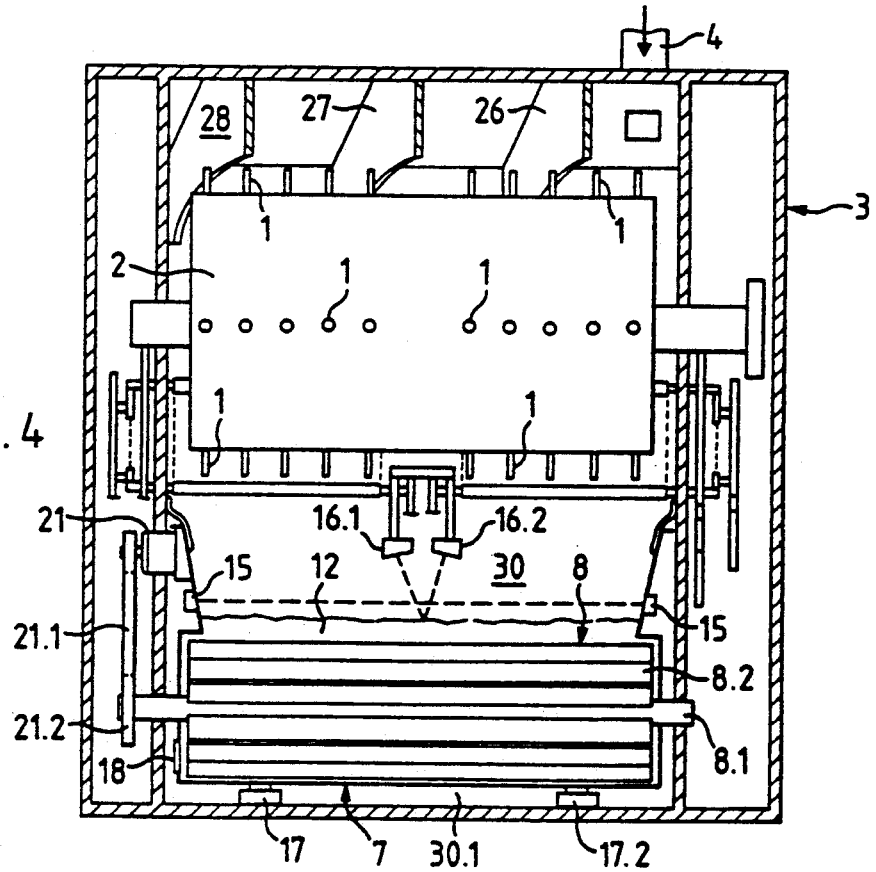
FIG. 4 shows the cleaning machine with the device according to the invention in a longitudinal section.

FIG. 4 shows the device according to the invention with reference to FIG. 2 in the longitudinal section. It can be seen here, that the trough, here called a collecting pan 7, with the paddle wheel 8 extends, over the length of the opening roller 2 arranged in the top of the machine. With this, the aerodynamic fringe area is an extended cylindrical covering similar to the segment of a pipe, with the thickness of the fringe area, on which the cleaning current runs on the smaller (internal) radius and builds up the pressure head on the larger radius (external). The whole is a dynamic equilibrium, with a dynamic process on one side and a static environment on the other with the fringe area between with a relatively large vulnerable spread. Parts of the device, such as the trough itself, the sensors and the control means should be arranged in the static environment, that is, in the chamber 30. This chamber 30 is protected against the environment with a lower pressure, that is, with the chamber 30.1. This is effected by means of edge seals, lip seals 7.1, 7.2 and other types of seals, on the trough 7 and through the layering 12 of the waste over the paddle wheel 8. The waste 12 is discharged by suction, this means, in the suction pipe 11, that is in the chamber 30.2, there is further underpressure compared to the underpressure in the chamber 30.1. The pressure balance is effected through the valve 13. The infiltrated air escaping from the chamber 30 must pass into the chamber 30.2 through the waste material filter layer 12, and through the leakage between the paddle wheel and the trough. Further, the drive 21 for the paddle wheel 8 can be seen in FIG. 4, not represented in full, which transmits the torque to the paddle wheel 8 via a V-belt 21.1 and a pulley 21.2, for example. The sensor means were already discussed in connection with FIG. 3 and the control means are not a subject of this application.

FIGS. 5A, 5B and 6 show a simplified embodiment of the invention in a vertical section and a longitudinal section, which dispenses with the paddle wheel and uses an amply proportioned suction pipe 19 instead. With the term "ample proportions" it is meant that the suction pipe openings (slots or holes) are provided through which the waste can be discharged by suction, which operation runs according to the principle previously explained. A suction operation can be undertaken before a blowing operation, which is shorter in time and less severe than the blast through the suction pipe. With this suction operation, a part of the waste lying above is drawn through into the suction pipe 19 through the openings in order to load the suction channel. This relatively gentle operation can be repeated several times before carrying out a final blowing operation through the suction pipe.

The pressure relationships are likewise a pressure head in the chamber 30, normal to excess pressure in the chamber 30.1 and underpressure in the chamber 30.2. The trough 7 stands likewise on pressure sensors 17 such as pressure sensors 17.1, 17.2 and 17.3 and the filling level sensor 15 functions in the same way described earlier. Likewise, a color measurement is provided through sensors 16 (which can be combined with a distance sensor). The decoupling for the weighing is effected over the sliding connection between the individual pressure chambers; in the pressure head chamber 30 the laminations are pressed against the trough 7, they can slide, however, even though they adhere to the wall of the trough through the contact pressure. In the chamber with normal pressure, the seal 14 is not pressed on, as underpressure only prevails during the suction operation in the chamber 30.2.

In addition, FIG. 5 shows two cascades 22, 22.1, respectively, in the trough 7 arranged opposite to each other with which the removal of the waste on the trough walls is made possible by spreading the waste outwards. According to empirically determined developments of such baffle plates, a thickening of the filter mat to a certain degree can be preserved in spite of the discharge operation.

While the invention has been described with reference to the foregoing embodiments, changes and modifications may be made thereto which fall within the scope of the appended claims.

What is claimed is:

1. A device for the discharging of waste from a fiber cleaning machine which includes a collecting basin and a connection for a suction device, the discharge device including pneumatic waste removal means arranged in a region of the collecting basin such that waste collects in the collecting basin and a suction device can be connected thereto, the discharge device further including weight indicating sensor means for determining a weight of the waste in the collecting basin or filling level sensor means for determining a filling level of the waste in the collecting basin or combination of the weight indicating and the filling level sensor means.

2. The device according to claim 1, wherein the collecting basin is provided with a collecting trough and the waste removal means comprises a motor driven paddle wheel arranged in a tapering part of the trough, the paddle wheel being rotatable in the collecting trough and forming collecting chambers and a suction chamber for the waste.

3. The device according to claim 1, wherein the waste is collected in a first pressure chamber defined by the collecting basin, the waste is removed in a second pressure chamber separated from the first chamber, the waste being removed by the waste removal means, seal means is provided between the first and second pressure chambers which have different pressures and the seal means can be decoupled.

4. The device according to claim 3, wherein the collecting basin includes walls which are closer together at a lower end thereof than at an upper end thereof, the lower end being vertically below the upper end and the weight indicating sensor means comprising weight sensor means supporting the container.

5. The device according to claim 3, wherein the waste removal means comprises a rotatable paddle wheel having a plurality of paddles, the seal means comprising flexible flaps which are sealingly engageable with a wall of the collecting basin, at least two of the flexible flaps being in sealing engagement with the wall during rotation of the paddle wheel so as to reduce leakage of air from the first pressure chamber to the second pressure chamber.

6. The device according to claim 3, wherein the waste removal means comprises a suction pipe having at least one opening providing fluid communication between the first pressure chamber and an interior of the suction pipe, the interior of the suction pipe defining the second pressure chamber.

7. The device according to claim 3, further comprising a fiber cleaning machine including an opening roller, inlet means for delivering a current of air and textile fibers at one end of the roller, grate means below the roller for passing impurities removed from the fibers into the first pressure chamber which is located below the grate means, the collecting basin being separated from a third pressure chamber by second seal means extending between the collecting basin and side walls of the machine, the third pressure chamber surrounding at least part of the second pressure chamber.

8. The device according to claim 7, further comprising suction means for applying suction to the second pressure chamber and one-way valve means for supplying air to the third pressure chamber, the second pressure chamber being in direct fluid communication with the third pressure chamber such that air from the third pressure chamber passes into the second pressure chamber when suction is applied to the second pressure chamber by the suction means so as to aid removal of the waste by the waste removal means.

9. The device according to claim 3, wherein the seal means provides a valve effect for sealing of a pressure drop between the first and second pressure chambers.

10. The device according to claim 9, wherein the sensor means comprises sensors.

11. The device according to claim 10, wherein the sensors are color sensors by means of which a proportion of clean fibers in the waste can be measured.

12. The device according to claim 10, wherein the sensors are weight sensors by means of which the weight of the waste can be measured.

13. The device according to claim 10, wherein the sensors are filling level sensors in the form of light barriers and/or distance measuring sensors.

14. The device according to claim 13, wherein the sensors include light barriers, color measuring sensors and pressure sensors.

15. A device for discharge of waste of textile fibers, the device being usable in a cleaning machine for cleaning the textile fibers wherein the machine includes an opening roller rotating in a casing and bar grates facing the opening roller, the device comprising a trough for collecting waste conducted through the bar grates and pneumatic waste discharging means for discharging waste from the trough, the pneumatic waste discharging means comprising a suction pneumatic system and sluice means for maintaining a pressure damping layer of waste in the trough during discharge of the waste into the suction pneumatic system.

16. The device according to claim 15, wherein the sluice means comprises a motor driven paddle wheel for transporting the waste out of the trough into the suction pneumatic system.

17. The device according to claim 15, wherein the trough is supported by weight sensors for measuring the amount of waste in the trough or sensors are provided for measuring the waste level in the trough.

18. The device according to claim 15, wherein the device includes color measuring sensors for measuring the color of the waste.

19. Cleaning apparatus for cleaning textile fibers comprising an opening roller rotatable in a casing and bar grates facing an outer periphery of the opening roller, the machine including a device for the discharge of waste conducted through the bar grates, the device including a trough for collecting the waste and pneumatic discharging means for discharging the waste out of the trough comprising a suction pneumatic system and sluice means for discharging the waste into the suction pneumatic system.

20. The device according to claim 19, wherein said sluice means maintains a pressure damping layer of waste in said trough during discharge of the waste through said outlet.

21. A waste discharge device for a textile fiber cleaning machine of the type having an opening roller rotatable in a casing and bar grates facing the opening roller, the device comprising a trough for collecting waste conducted through the bar grates, and pneumatic waste discharging means for discharging waste from said trough, said pneumatic waste discharging means including an outlet connectable to a source of suction and sluice means for effecting passage of waste from said trough to said outlet.

22. The device according to claim 21, wherein said sluice means maintains a pressure damping layer of waste in said trough during discharge of the waste through said outlet.

23. Cleaning apparatus for cleaning textile fibers comprising an opening roller rotatable in a casing, bar grates facing an outer periphery of the opening roller, a trough for collecting waste conducted through the bar grates, a suction collecting means for receiving waste from said trough while maintaining substantially constant pressure in the vicinity of said bar grates, and an outlet in communication with the suction collecting means, the outlet being connectable to a source of suction for removing waste from the suction collecting means.

24. The cleaning apparatus of claim 23, further comprising means for maintaining a pressure damping layer of waste in said trough between said bar grates and the suction collecting means.

25. The cleaning apparatus of claim 24, comprising a paddle wheel for controlling communication between said trough and said suction collecting means.

26. The cleaning apparatus of claim 24, wherein the suction collecting means comprises a pipe and wherein suction pipe openings extend between said trough and an interior of said pipe.

27. A waste discharge device for a textile fiber cleaning machine of the type having an opening roller rotatable in a casing and bar grates facing the opening roller, the device comprising a trough for collecting waste conducted through the bar grates, a suction collecting means for communicating with said trough and having an outlet connectable to a source of suction for removing waste from the suction collecting means, and means for controlling the passage of waste from said trough to said suction collecting means and maintaining substantially constant pressure in the vicinity of the bar grates.

28. The device of claim 27, wherein said means for controlling the passage of waste from said trough to said suction collecting means comprises a paddle wheel.

29. The device of claim 27, wherein said suction collecting means comprises a pipe and said means for controlling the passage of waste from said trough to said suction collecting means comprises suction pipe openings in said pipe for providing communication between said trough and the interior of said pipe.

30. The device of claim 27, further comprising means for maintaining a pressure damping layer of waste in said trough during discharge of waste through said outlet.

* * * * *